US008104700B2

(12) United States Patent
Gietz et al.

(10) Patent No.: US 8,104,700 B2
(45) Date of Patent: Jan. 31, 2012

(54) METHOD FOR OPERATING A BEATER WHEEL MILL AND CONTROLLER FOR CONTROLLING A BEATER WHEEL MILL

(76) Inventors: Manfred Gietz, Stuttgart (DE); Werner Koch, Hirschberg (DE); Anneliese Koch, legal representative, Hirschberg (DE); Volker Schüle, Leimen (DE); Wolfgang Rieker, Eschenbach (DE)

( * ) Notice: Subject to any disclaimer, the term of this patent is extended or adjusted under 35 U.S.C. 154(b) by 197 days.

(21) Appl. No.: 12/532,440

(22) PCT Filed: Mar. 25, 2008

(86) PCT No.: PCT/EP2008/002337

§ 371 (c)(1),
(2), (4) Date: Sep. 22, 2009

(87) PCT Pub. No.: WO2008/116624

PCT Pub. Date: Oct. 2, 2008

(65) Prior Publication Data

US 2010/0108789 A1 May 6, 2010

(30) Foreign Application Priority Data

Mar. 23, 2007 (DE) ..... 10 2007 014 129

(51) Int. Cl.
*B02C 2/04* (2006.01)

(52) U.S. Cl. ..... 241/27; 241/33

(58) Field of Classification Search ..... 241/27, 241/185.1–197, 33, 35, 36
See application file for complete search history.

(56) References Cited

U.S. PATENT DOCUMENTS 4,856,716 A * 8/1989 Burstedt ..... 241/30
6,467,707 B1 10/2002 Williams, Jr.
7,028,931 B2 * 4/2006 Lin et al. ..... 241/79.1

FOREIGN PATENT DOCUMENTS

DE 301241 5/1992
WO WO2004/004908 1/2004

* cited by examiner

*Primary Examiner* — Faye Francis
(74) *Attorney, Agent, or Firm* — Lawrence P. Zale

(57) ABSTRACT

The invention relates to a method, which can be used to detect the wear of prebeater heads of a prebeater (1) of a beater wheel mill in a simple manner.

10 Claims, 3 Drawing Sheets

METHOD FOR OPERATING A BEATER WHEEL MILL AND CONTROLLER FOR CONTROLLING A BEATER WHEEL MILL

Beater mills with prebeaters are used in particular for preparation of brown coal in power stations. The prebeater is arranged upstream of the beater mill and comminutes the brown coal before it reaches the beater mill. The prebeater comprises a plurality of beating arms which are arranged radially with respect to a rotation axis and at whose outer ends beater heads are arranged. These solid beater heads are generally composed of steel and are subject to severe wear because of the abrasive components of the brown coal. They are therefore detachably connected to the beating arms, so that they can be replaced after the maximum permissible wear has been reached.

In general, the beater heads are replaced after an operating period of 1500-3000 hours. In this case, the time at which the beater heads are replaced is defined on the basis of empirical values, for example an operating period of 1800 hours.

Since the beating arms and other components of the prebeater will be damaged if the beater head wear is excessive, the intervals within which the beater heads are replaced in operational practice are chosen to be relatively short, and a certain amount of "wear reserve" is accepted. The wear on the beater heads cannot be detected during operation of the beater mill. For this purpose, the mill must be shut down, and the beater heads must be visually checked for wear.

However, since the wear on the beater heads does not depend exclusively on the operating time but, for example, also on the proportion of abrasive particles in the coal, time-controlled replacement of the beater heads is generally unsatisfactory since, in general, the maximum operating time of the beater heads is not utilized, or the beater mill is shut down on an unnecessarily large number of occasions.

The invention is based on the object of providing a method for operation of a beater mill with a prebeater, which allows optimum utilization of the life of the beater heads while at the same time offering a high degree of confidence against excessively long operation of the beater heads. At the same time, the method according to the invention is intended to take account of the relationship between the life of the beater heads and the coal that is used, as well as other external influences, in a reasonable manner.

The object on which the invention is based is achieved according to the invention by a method for operation of a prebeater in a beater mill, with the prebeater having a plurality of prebeater heads, in that the power consumption of the drive of the prebeater is recorded, and in that the wear on the beater heads is determined as a function of the power consumption of the drive.

The inventors have discovered that there is a unique relationship between the power consumption of the drive for the prebeater and the wear on the beater heads. As the beater head wear increases, they naturally become smaller, as a result of which the required drive power for the prebeater decreases.

The method according to the invention makes use of this relationship and thus makes it possible to optimally utilize the life of the beater heads. The shutdown times which have been required until now for visual inspection can therefore be completely avoided, and the operating costs and maintenance costs considerably reduced. Furthermore, the method according to the invention makes it possible to effectively prevent the beater heads from being operated beyond the permissible wear limit even when using coal with high abrasive contents. In consequence, consequential damage resulting from the permissible wear limit being exceeded can be reliably prevented. This also reduces the operating costs of a beater mill operated using the method according to the invention.

The method according to the invention can also be implemented highly cost-effectively since the power consumption of the drive of the prebeater is the only input variable that is required for the method. If it is not already recorded in any case, the power consumption can easily be recorded, as a result of which the hardware preconditions in the form of sensors and signal lines are very low.

A further advantageous refinement of the method according to the invention provides that a sliding time mean value of the power consumption is formed, that the sliding time mean value of the power consumption is compared with a first threshold value, and that a first warning message is emitted when the sliding time mean value of the power consumption undershoots the first threshold value $I_{warn}$.

This mean-value formation process acts like a low-pass filter, as a result of which brief fluctuations in the power consumption do not lead to the emission of a warning message. This makes it possible to filter out brief fluctuations in the power consumption, such as those which are caused by brief fluctuations in the composition of the coal or by other disturbance influences.

Alternatively or additionally, it is possible to compare the sliding time mean value of the power consumption with a second threshold value, $I_{max.wear}$ and to emit a second warning message when the sliding time mean value of the power consumption undershoots the second threshold value, $I_{max.wear}$.

Finally, it is possible to switch the prebeater off automatically when a third threshold value $I_{switch\text{-}off}$ is undershot, when the sliding time mean value of the power consumption undershoots the third threshold value $I_{switch\text{-}off}$.

The graduated and successive emission of different warning indications makes it possible on the one hand to indicate the incipient end of the operating period of the life of the beater heads in a timely manner. This can be done by the first warning indication $I_{warn}$.

As soon as the permissible wear limit has been reached, a second warning message is emitted which, for example, comprises not only a visual signal but also an audible signal. This indicates to the operator of the power station, without any possibility of misunderstanding, that the beater heads need to be replaced.

If the beater heads have not been replaced despite these warning messages having been emitted, the beater mill can also be shut down automatically by the method according to the invention after a further, third threshold value, $I_{switch\text{-}off}$ is undershot. This reliably prevents damage to the peripherals of the beater heads, in particular to the beating arms and other components. It is self-evident that, in general, this third threshold value should not be reached but that the replacement of the beater heads can be prepared for and planned after the first warning indication is emitted, which means that the beater heads can be replaced immediately when the second warning indication occurs, or shortly before it.

The drive for the prebeater is advantageously an electrical drive with an electric motor.

Since these electric motors are in general operated at a constant voltage, the power consumption can be determined by a current measurement. It would, of course, also be possible to record the power via the temperature of the windings in the motor. Temperature monitoring such as this is provided in any case in motors of this power class, in order to prevent overloading of the motor.

In operational practice, it has been found to be advantageous for the power consumption of the drive within a time interval with a period from one operating hour to 24 operating hours, preferably with a period from one operating hour to eight operating hours to be used to determine the sliding time mean value.

In this case, starting from the present time, the time interval is extended into the recent past, so that the sliding time mean value determined in this way maps the state of the beater heads as close to real time as possible.

The object mentioned initially is likewise achieved by a computer program and open-loop and/or closed-loop control device for a prebeater, with the computer program and the open-loop and/or closed-loop control device operating using one of the methods according to the invention.

Further advantages and advantageous refinements of the invention can be found in the following drawing and in the patent claims. All of the advantages described in the drawing, its description and the patent claims may be significant to the invention both individually and in any desired combination with one another.

Figure 1:
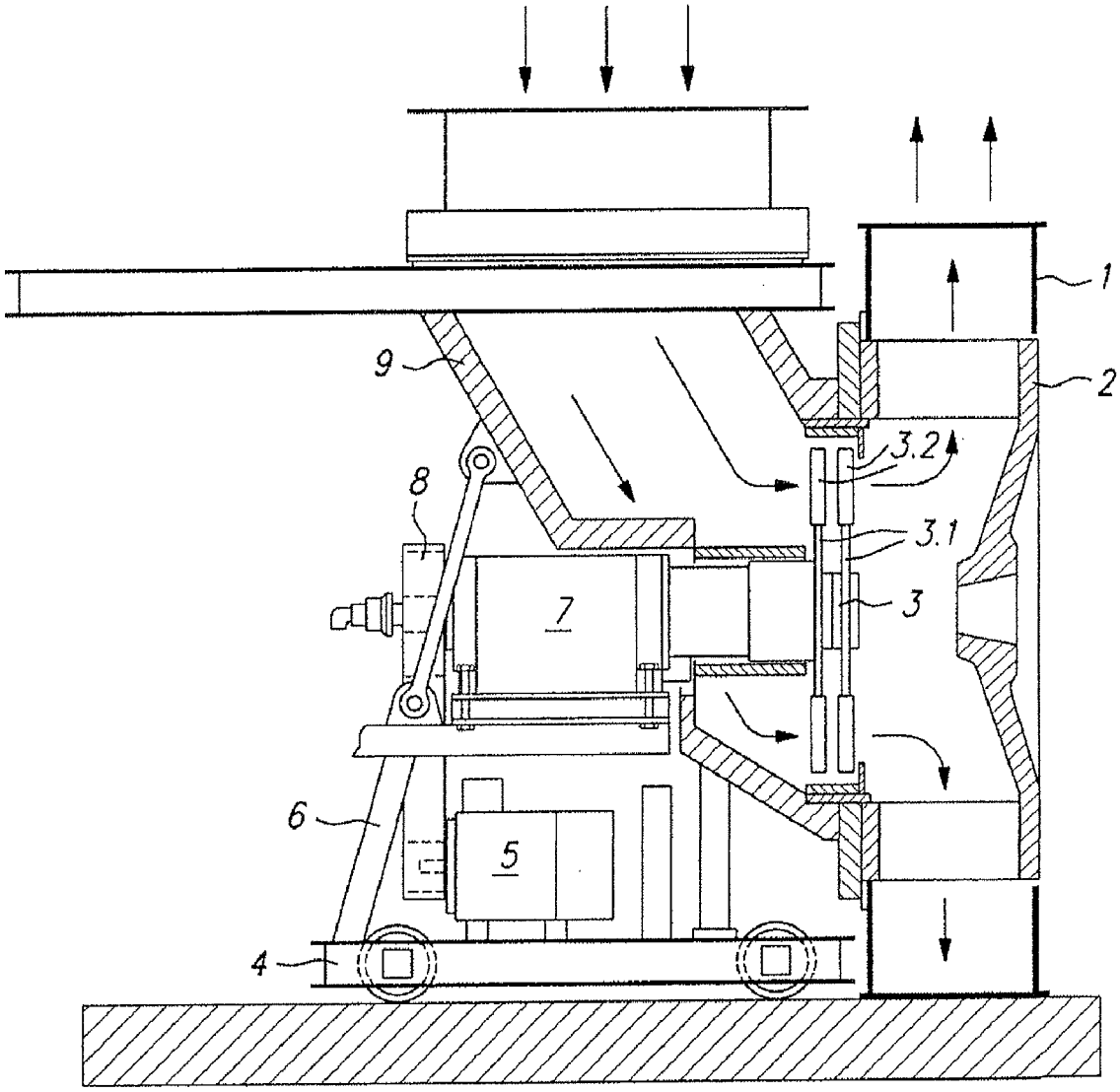
FIG. 1 shows a cross section through a beater mill.

FIG. 1 shows a cross section of a beater mill, which is known from the prior art, with a prebeater. A beating wheel 2 is arranged in a mill housing 1. The bearing and the drive for the beating wheel 2 are not shown in FIG. 1.

The path of the coal to be comminuted through the beater mill is indicated by arrows (without reference signs).

Before the coal to be comminuted axially enters the beating wheel 2, it must pass the so-called prebeater. This prebeater essentially comprises a prebeater rotor 3. The prebeater rotor 3 in turn comprises beating arms 3.1, which extend radially outwards. Beating arm heads 3.2 are detachably attached to the outer ends of the beating arms 3.1. As can be seen from FIG. 1, a plurality of beating arms 3.1 can be arranged one behind the other in the axial direction. The prebeater 3 is likewise on floating bearings. The associated bearing has the reference sign 7.

The prebeater rotor 3 is driven by an electric motor 5. Power is transmitted between the motor 5 and the prebeater rotor 3 via a belt drive 8. The bearings for the prebeater and the drive motor 5 are arranged in a frame 6.

As indicated by the arrows, the coal to be comminuted enters the prebeater via a mill door 9, is comminuted there by the prebeater heads 3.2, and is then passed to the beating wheel 2 where the coal is further comminuted, so that the coals are of the desired size. At the same time, the coal is radially accelerated through the beating wheel 2 together with the surrounding air, and is passed out of the beating mill via an outlet from the mill housing 1.

Figure 2:
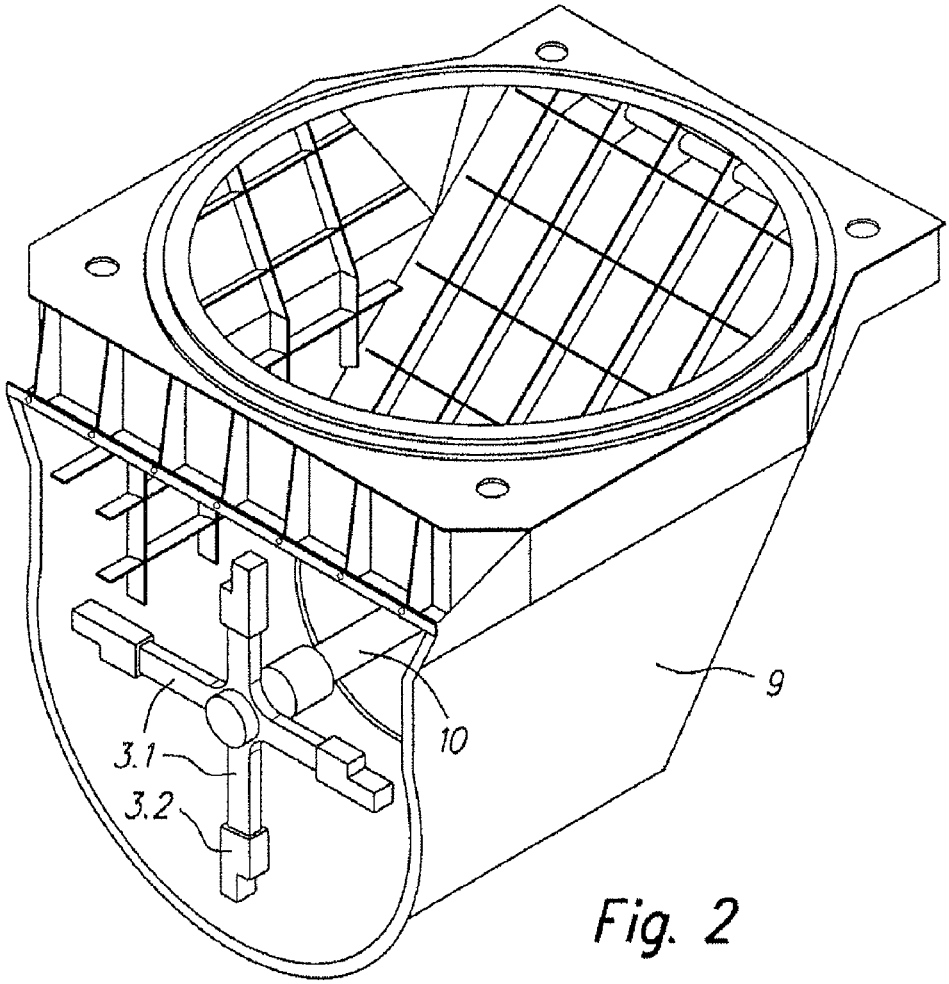
FIG. 2 shows an isometric illustration of a mill door and of a prebeater.

In order to illustrate what has been stated, FIG. 2 shows a mill door 9 with the prebeater rotor 3 and the associated shaft 10, which is part of the bearing 7. The shape of the beating arms 3.1 and of the prebeater heads 3.2 can be seen well in this isometric illustration.

For clarity reasons, only the cross located at the shaft end of the beating arms 3.1 with the associated prebeater heads 3.2 is provided with a reference sign. The cross of beating arms arranged behind this in the direction of the bearing is not provided with a reference sign.

Figure 3:
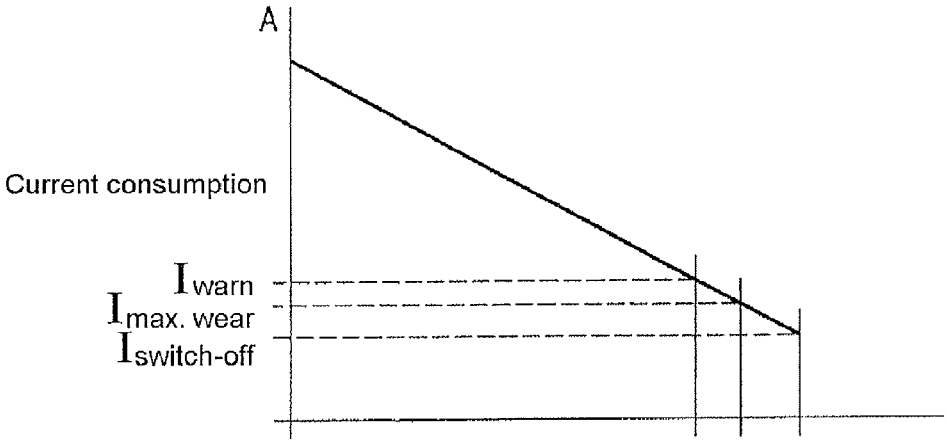
FIG. 3 shows the relationship between the wear of the beater heads and the power consumption of the prebeater.

The prebeater heads 3.2 are composed of a wear-resistant material, in particular of steel, and become ever smaller as the operating time continues, as a result of the abrasive components of the brown coal to be comminuted. In addition, all edges which result in particularly effective comminution of the brown coal are, of course, worn away, and the shape of the prebeater heads becomes ever more "streamlined". In consequence, the effectiveness of the initial comminution by the prebeater decreases, as a result of which the power consumption of the motor 5 decreases. This relationship is illustrated in the form of a graph in FIG. 3.

The wear, corresponding to a weight decrease in kilograms of the prebeater heads, is plotted on the X axis. The current consumption of the motor 5 is shown on the Y axis. As can be seen from FIG. 3, there is a clear relationship between the current consumption and the weight decrease of the prebeater heads. The method according to the invention makes use of this effect by recording the power consumption of the motor 5, preferably by means of a sliding time mean value, and comparing this with one or more threshold values.

As soon as a first threshold value $I_{warn}$ is undershot, a first warning signal is emitted, as a result of which the crew of the power station know that the prebeater heads have virtually reached the end of their life.

As soon as a second threshold value $I_{max.wear}$ is reached, a second warning signal is emitted, and the crew know that the prebeater heads must now be replaced without delay.

If the crew do not react to this, and operation of the prebeater heads continues further, the power consumption of the motor 5 decreases further until a third threshold value $I_{switch\text{-}off}$ is reached. When this third threshold value is reached, the beater mill is switched off automatically, in order to prevent consequential damage to the beating arms and other components.

Figure 4:
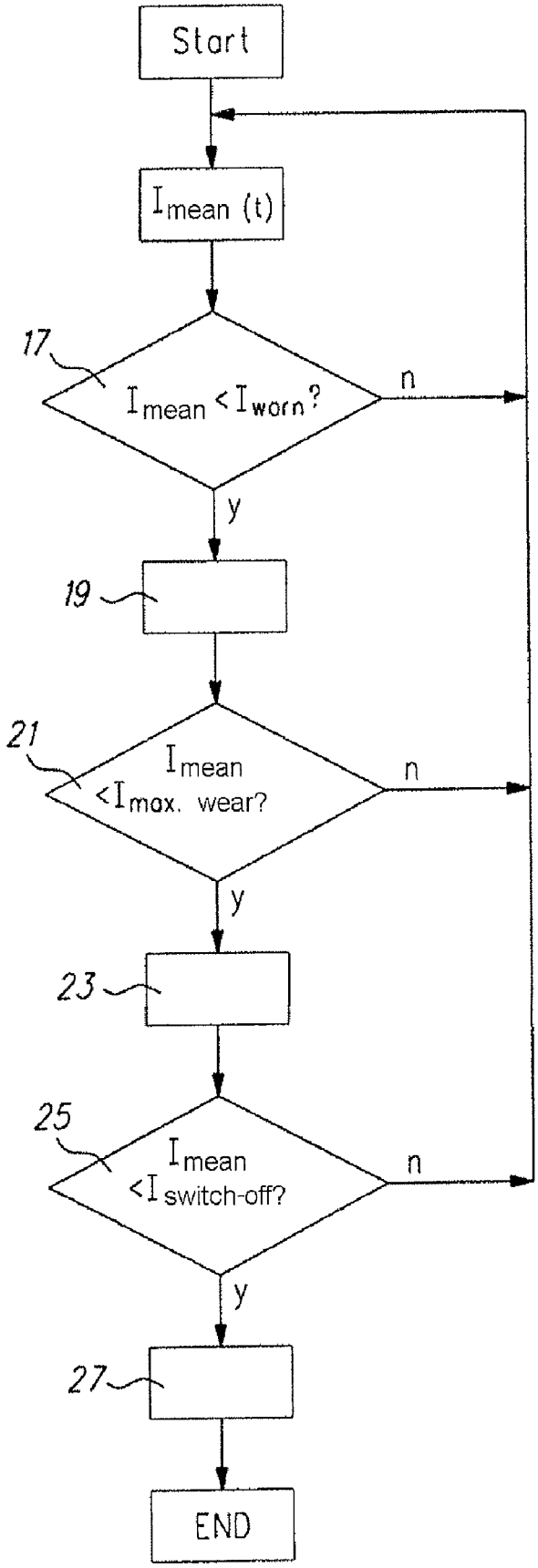
FIG. 4 shows a flowchart of one exemplary embodiment of a method according to the invention.

FIG. 4 shows a flowchart of the method according to the invention.

The method begins in a start block. In a first step 15, the power consumption of the motor 5 is recorded, and a sliding time mean value $I_{mean}$ is formed. In a block 17, this sliding time mean value $I_{mean}$ is compared with a first threshold value $I_{warn}$. If the sliding time mean value $I_M$ is greater than the first threshold value, the method branches again to before the first block 15. Otherwise, a first warning is emitted in a third block 19.

A comparison is carried out in a fourth block 21 to determine whether the power consumption $I_{mean}$ is less than a second threshold value, $I_{max.wear}$. If this is not the case, the method branches to behind the start block again. Otherwise, a second warning indication is emitted in a fifth block 23.

The method then passes through a sixth block 25 in which a check is carried out to determine whether the power consumption $I_{mean}$ is less than a third threshold value $I_{switch\text{-}off}$. If not, the program branches back again to behind the start block. Otherwise, the beater mill is switched off in a seventh block 27. The method then ends.

What is claimed is:

1. A method for operation of a motor-driven prebeater of a beater mill, with a prebeater having at least one rotor with a plurality of prebeater heads, comprising:

recording the power consumption of a drive for the prebeater; and determining the wear on the prebeater heads as a function of the power consumption of the drive.

2. The method according to claim 1, further comprising:

forming a sliding time mean value ($I_M$) of the power consumption;

comparing the sliding time mean value ($I_M$) of the power consumption with a first threshold value ($I_{warn}$); and emitting a first warning message when the sliding time mean value ($I_M$) of the power consumption undershoots the first threshold value ($I_{warn}$).

3. The method according to claim 2, further comprising:

comparing the sliding time mean value ($I_M$) of the power consumption with a second threshold value ($I_{max.wear}$); and emitting a second warning message when the sliding time mean value ($I_M$) of the power consumption undershoots the second threshold value ($I_{max.wear}$).

4. The method according to claim 3, further comprising:

comparing the sliding time mean value ($I_M$) of the power consumption with a third threshold value ($I_{switch\text{-}off}$); and switching off the prebeater automatically when the sliding time mean value ($I_M$) of the power consumption undershoots the third threshold value ($I_{switch\text{-}off}$).

5. The method according to claim 1, wherein the drive is an electrical drive with an electric motor.

6. The method according to claim 5, wherein the power consumption of the electrical drive is recorded by a current measurement.

7. The method according to claim 2, wherein the power consumption of the drive within a time interval from one to 24 operating hours, from one to eight operating hours, is used to determine the sliding time mean value ($I_M$).

8. The method according to one claim 2, wherein the power consumption of the electrical drive in the recent past is used to determine the sliding time mean value ($I_M$).

9. The method of claim 1, wherein the step of determining the wear comprises the step of:

employing a computer program configured to determine the wear on the prebeater heads as a function of the power consumption of the drive.

10. The method of claim 1, wherein the step of determining the wear comprises the step of:

employing one of an open-loop or closed-loop control device for the prebeater, configured to determining the wear on the prebeater heads as a function of the power consumption of the drive.

* * * * *